US010675739B2

(12) United States Patent
Miley et al.

(10) Patent No.: US 10,675,739 B2
(45) Date of Patent: Jun. 9, 2020

(54) MULTI-FUNCTION SOCKET

(71) Applicant: APEX BRANDS, INC., Apex, NC (US)

(72) Inventors: Chad Aaron Miley, Camden, OH (US); Timothy Edward Heitkamp, Tipp City, OH (US)

(73) Assignee: APEX BRANDS, INC., Apex, NC (US)

( * ) Notice: Subject to any disclaimer, the term of this patent is extended or adjusted under 35 U.S.C. 154(b) by 199 days.

(21) Appl. No.: 15/787,465

(22) Filed: Oct. 18, 2017

(65) Prior Publication Data

US 2018/0111252 A1 Apr. 26, 2018

Related U.S. Application Data

(60) Provisional application No. 62/410,556, filed on Oct. 20, 2016.

(51) Int. Cl.

| | |
|---|---|
| ***B25B 13/10*** | (2006.01) |
| ***B25B 23/00*** | (2006.01) |
| ***B25B 23/12*** | (2006.01) |
| ***B25B 13/06*** | (2006.01) |

(52) U.S. Cl.

CPC ..... *B25B 13/102* (2013.01); *B25B 13/06* (2013.01); *B25B 23/0035* (2013.01); *B25B 23/12* (2013.01)

(58) Field of Classification Search

CPC ... B25B 13/102; B25B 13/06; B25B 23/0035; B25B 23/12

USPC ..... 81/124.5

See application file for complete search history.

(56) References Cited

U.S. PATENT DOCUMENTS

| | | | | |
|---|---|---|---|---|
| 2,720,804 | A * | 10/1955 | Brown | B25B 23/12 294/65.5 |
| 3,392,767 | A * | 7/1968 | Stillwagon, Jr. | B25B 23/12 7/165 |
| 3,869,945 | A * | 3/1975 | Zerver | B25B 13/483 81/125 |
| 7,082,864 | B1 * | 8/2006 | Weber | B25B 13/06 81/180.1 |
| 8,196,495 | B2 * | 6/2012 | Chen | B25B 13/06 81/125 |
| 8,943,931 | B2 * | 2/2015 | Chiang | B25B 15/001 279/75 |
| 9,505,108 | B2 * | 11/2016 | Peters | B25B 23/12 |

(Continued)

*Primary Examiner* — Hadi Shakeri
(74) *Attorney, Agent, or Firm* — Burr & Forman, LLP

(57) ABSTRACT

A socket may include a socket body comprising a fastener engagement aperture configured to receive at least a portion of a fastener and a forward sleeve affixed external to the socket body at a forward end of the socket body. The forward sleeve may be configured to rotate radially relative to the socket body, and translate axially relative to the socket body. The socket may also include a biasing member configured to urge the forward sleeve to translate axially relative to the socket body in a direction towards the forward end of the socket body. Further, the socket body may include an internal cavity, and the socket may include a magnet disposed within the internal cavity. The magnet may be configured to translate axially within the internal cavity relative to the socket body and be configured to magnetically attract the fastener to the forward end of the socket body.

11 Claims, 7 Drawing Sheets

(56) References Cited

U.S. PATENT DOCUMENTS

Figure 1A:
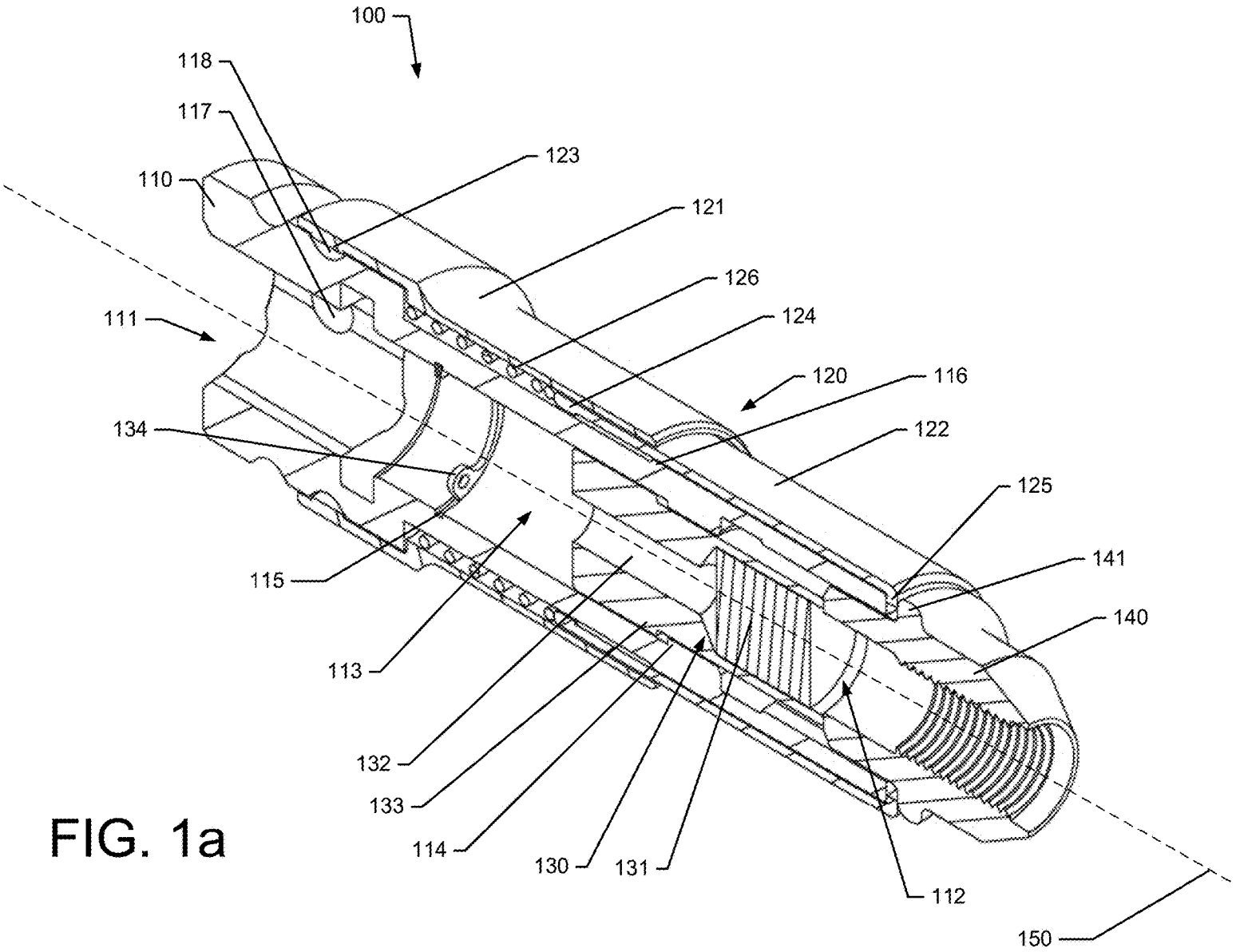

2003/0131694 A1* 7/2003 Lin ..... B25B 15/001
81/438

* cited by examiner

MULTI-FUNCTION SOCKET

CROSS REFERENCE TO RELATED APPLICATION

This application claims priority to U.S. application No. 62/410,556 filed Oct. 20, 2016, the entire contents of which are hereby incorporated by reference in its entirety.

TECHNICAL FIELD

Example embodiments generally relate to tools for applying or removing fasteners and, in particular, relate to sockets driven by rotating hand or power tools that apply or remove fasteners.

BACKGROUND

Sockets are familiar tools for applying and removing threaded fasteners, such as nuts and bolts. Sockets are typically sized and shaped to marry with at least a portion of the threaded fastener having a corresponding size and shape. With the assistance of the socket, the threaded fastener may be turned by a wrench or rotating power tool to apply or remove the threaded fastener and secure or unsecure, respectively, the fastener and an item that the fastener is securing.

Some conventional sockets can come into contact with a surface of the item to be secured surrounding the fastener during application or removal. As a result of the interaction between the socket and the item's surface, the surface may be marred. For example, when applying a lug nut, some conventional sockets come into physical contact with a surface of a wheel rim surrounding the position where the lug nut is being applied. When the socket is turned to affix the lug nut to the lug post, the physical contact between the socket and the rim can mar the surface of the rim. In some circumstances, this physical contact between the socket and the surface surrounding the fastener can be the result of the length of fastener being smaller than the depth of the socket aperture. Further, the same socket is often utilized with a variety of fasteners having different lengths thereby increasing the risk of marring.

In this regard, on some automotive assembly lines multiple models of vehicles may be constructed on the same line. Sometimes, different models require different types of fasteners. For example, the lug nut on a consumer version of a car may be of a certain length, but the police department version of the same car may require the same width nut but a shorter nut having a flange or an extended flange. Likewise, different length nuts or styles of nuts (e.g., with an extended flange, narrower flange, or no flange) may be utilized on a consumer version of a truck versus commercial version of the same truck. Automobile manufacturers need to be able to switch over the line quickly between models and therefore tools that can accommodate both models and a variety of fasteners while still maintaining anti-marring features provide an advantage.

Thus, it is desirable to provide a new design for a socket that addresses these concerns.

BRIEF SUMMARY OF SOME EXAMPLES

Some example embodiments may enable the provision of a socket apparatus having anti-marring functionalities. Additionally, or alternatively, some example embodiments may enable the provision of a socket apparatus that is configured to engage fasteners (e.g., nuts, bolts, etc.) having various lengths and shape features, while maintaining anti-marring functionalities.

According to some example embodiments, an example socket is provided that may comprise a socket body, a forward sleeve, and a biasing member. The socket body may comprise a fastener engagement aperture configured to receive at least a portion of a fastener. The socket body may also define an axis of rotation that passes through a center of the fastener engagement aperture. The example socket may further comprise a forward sleeve affixed external to the socket body at a forward end of the socket body adjacent the fastener engagement aperture. In this regard, the forward sleeve may be configured to rotate radially relative to the socket body and the axis of rotation, and the forward sleeve may be configured to translate axially relative to the socket body and the axis of rotation. Further, the example socket may comprise a biasing member configured to urge the forward sleeve to translate axially relative to the socket body and the axis of rotation in a direction towards the forward end of the socket body.

According to some example embodiments, an example socket is provided that may comprise socket body, and a magnet. The socket body may comprise an internal cavity and a fastener engagement aperture configured to receive at least a portion of a fastener. The socket body may define an axis of rotation that passes through a center of the fastener engagement aperture. The magnet may be disposed within the internal cavity of the socket body. The magnet may be configured to translate axially within the internal cavity relative to the socket body and the axis of rotation. The magnet may be further configured to magnetically attract the fastener to the forward end of the socket body.

BRIEF DESCRIPTION OF THE SEVERAL VIEWS OF THE DRAWING(S)

Figure 1B:
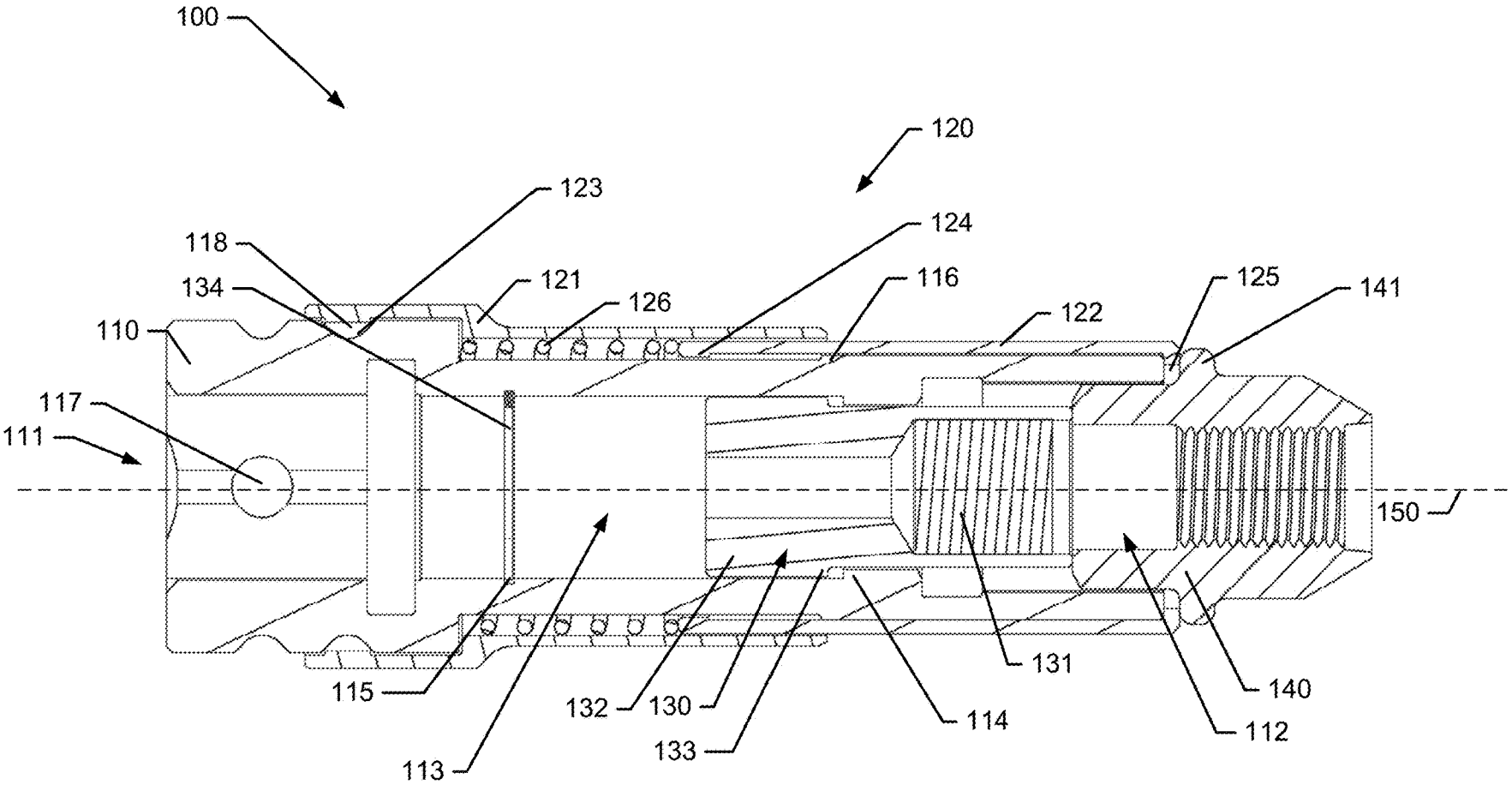
Figure 2A:
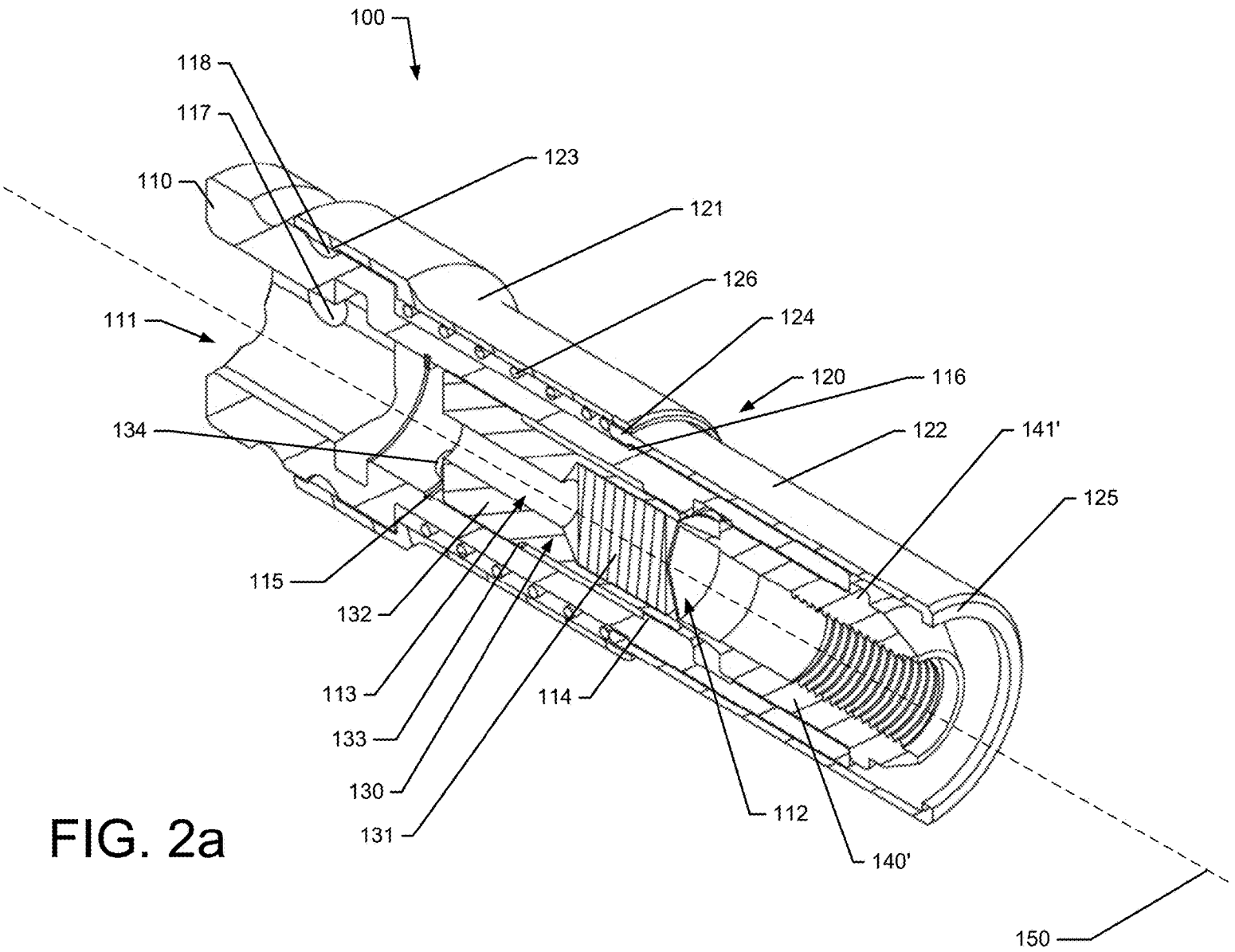
Figure 2B:
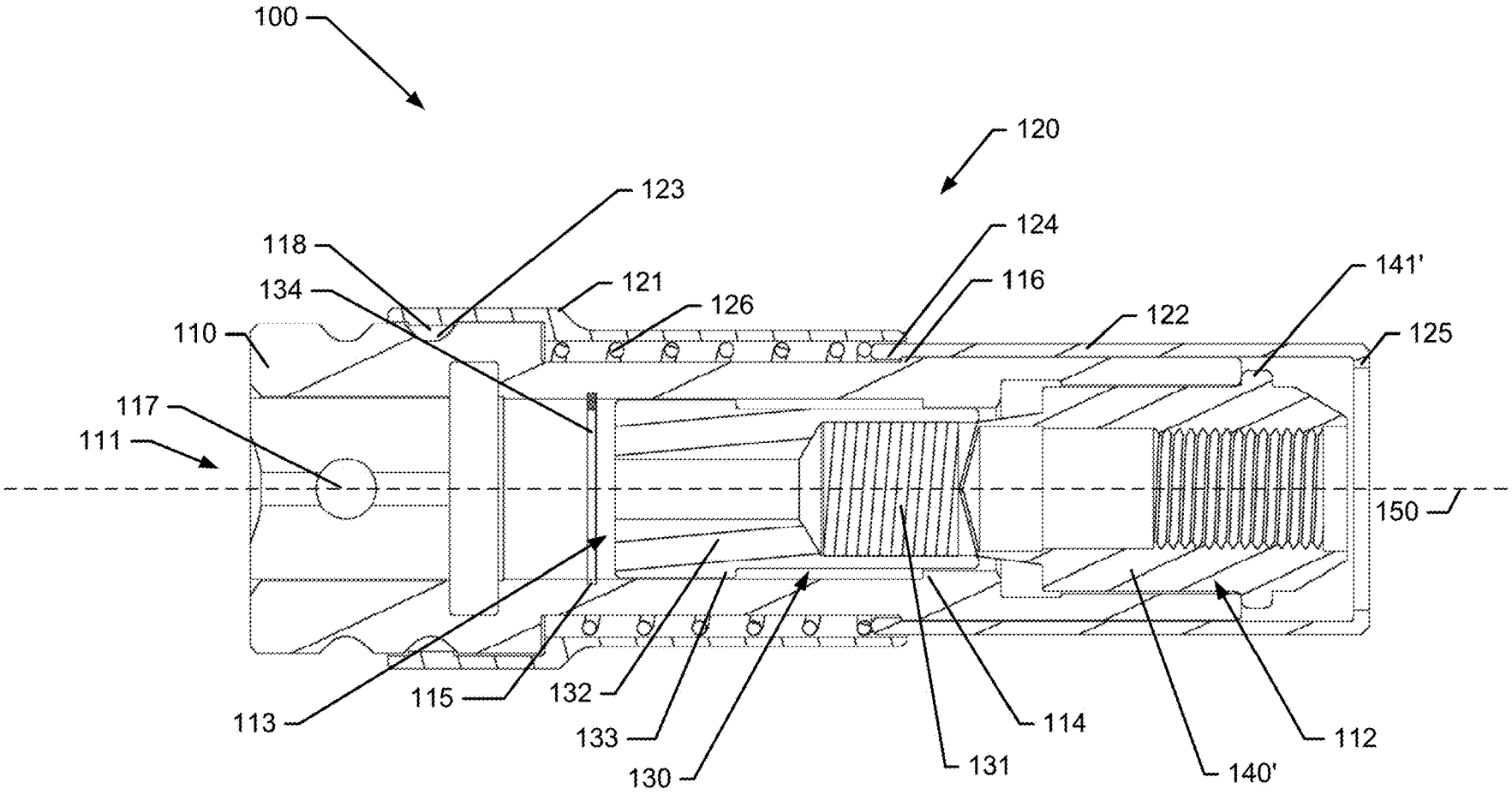
Figure 3:
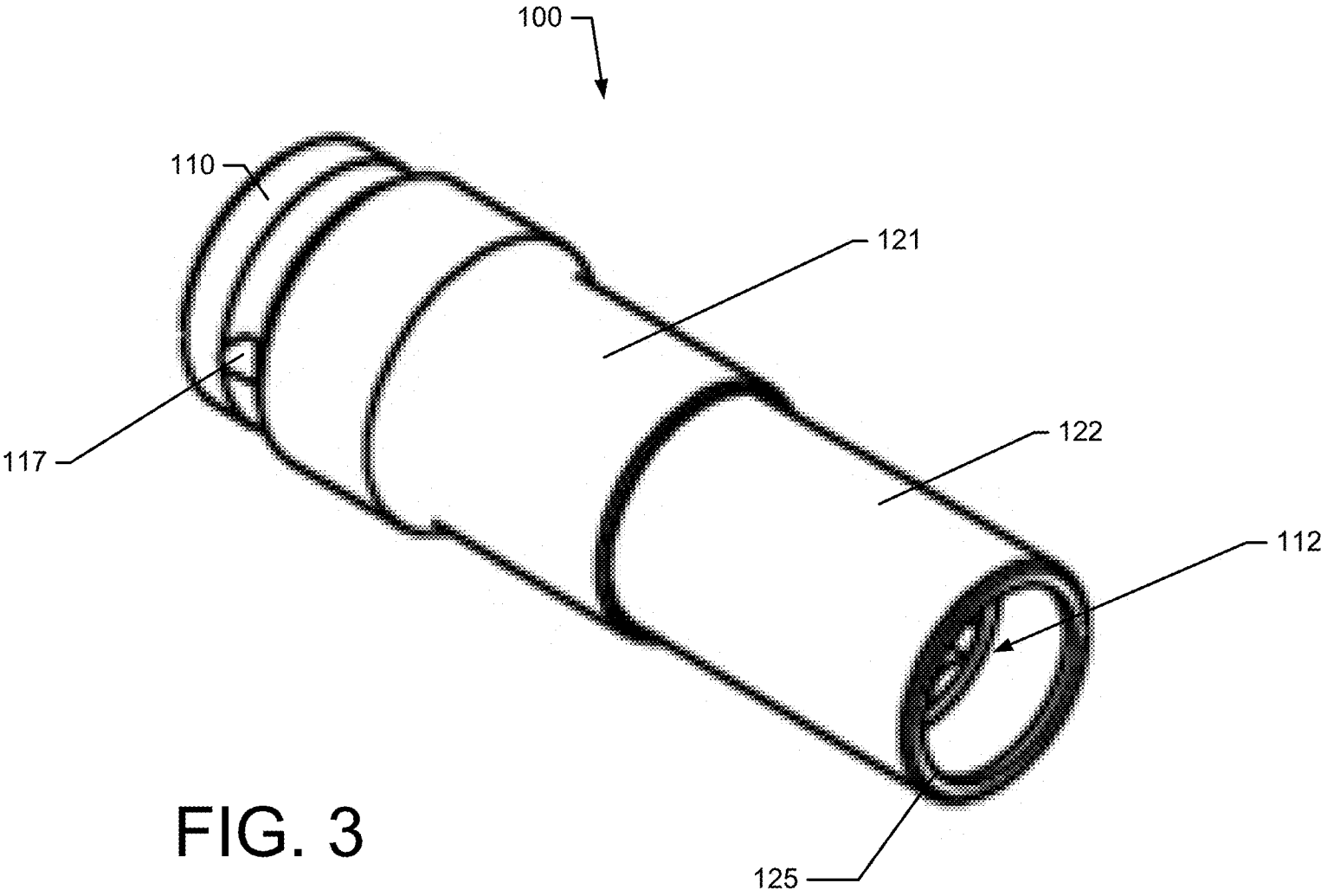
Figure 4A:
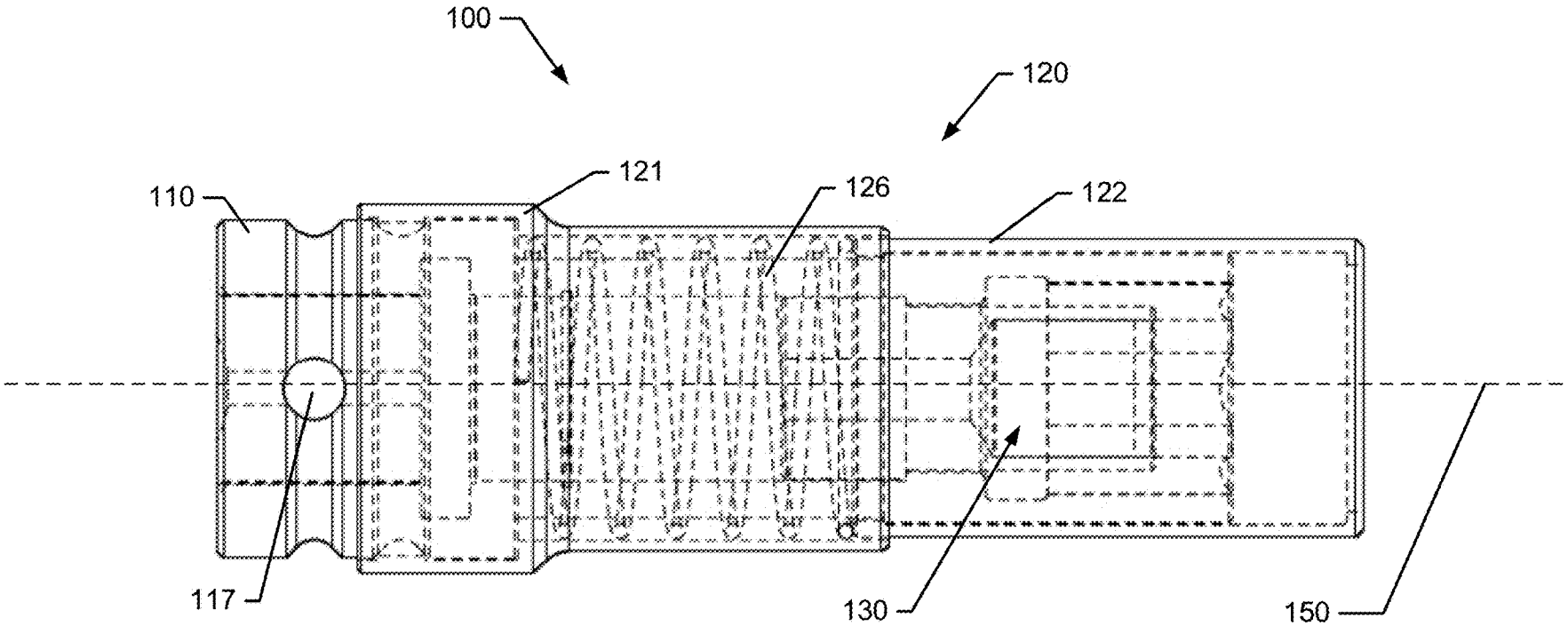
Figure 4C:
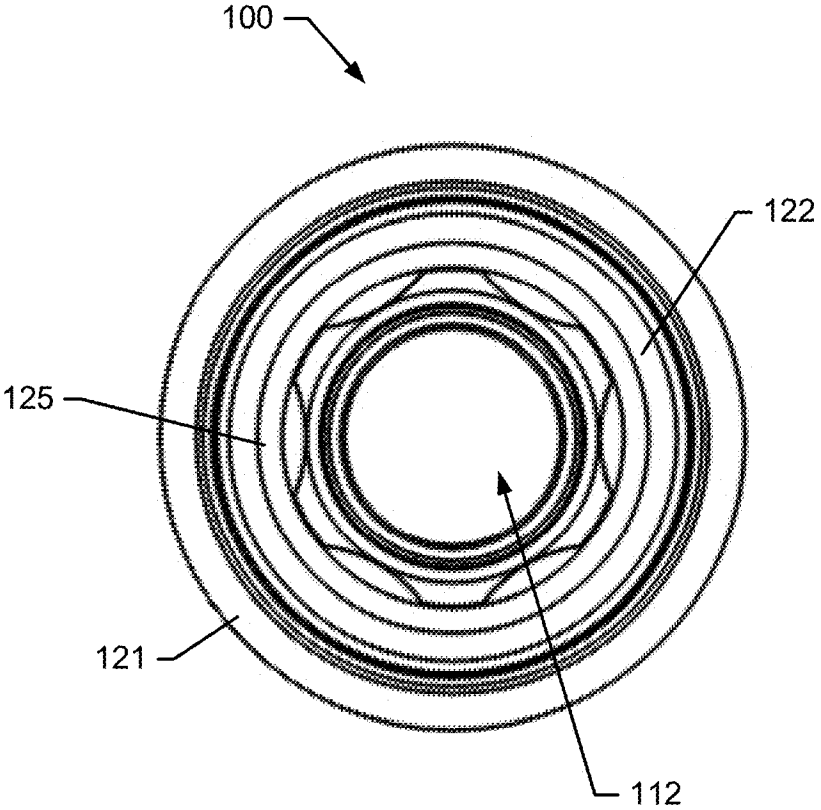
Figure 4B:
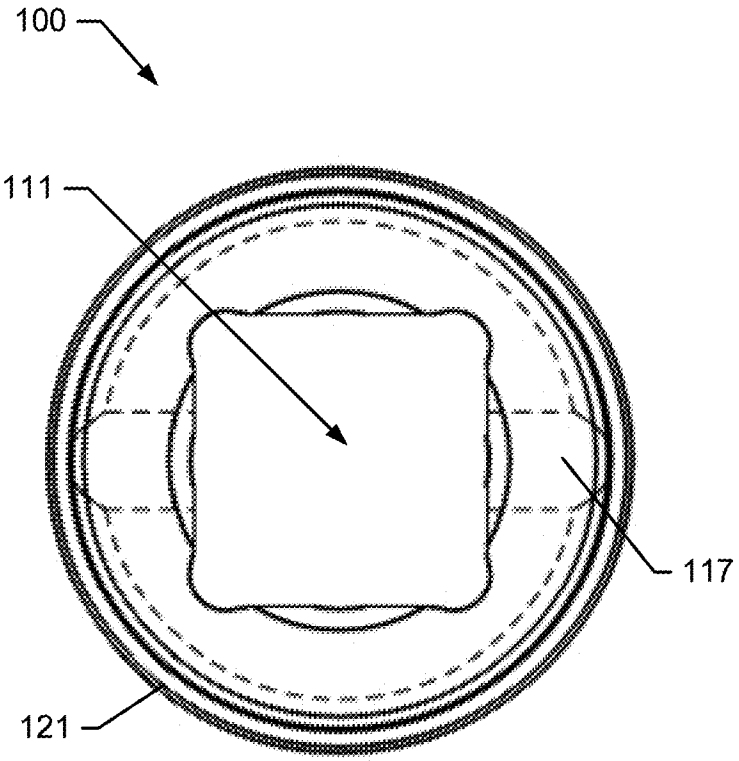

Having thus described some example embodiments in general terms, reference will now be made to the accompanying drawings, which are not necessarily drawn to scale, and wherein:

FIG. 1*a* illustrates a cross-section perspective view of an example socket engaged with an extended flange lug nut according to an example embodiment;

FIG. 1*b* illustrates a cross-section side view of an example socket engaged with an extended flange lug nut according to an example embodiment;

FIG. 2*a* illustrates a cross-section perspective view of an example socket engaged with a short flange lug nut according to an example embodiment;

FIG. 2*b* illustrates a cross-section side view of an example socket engaged with a short flange lug nut according to an example embodiment;

FIG. 3 illustrates a perspective view of an example socket according to an example embodiment;

FIG. 4*a* illustrates a side view of an example socket with internal elements shown in dotted lines according to an example embodiment;

FIG. 4*b* illustrates a rear view of an example socket according to an example embodiment; and FIG. 4*c* illustrates a front view of an example socket according to an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true.

As indicated above, some example embodiments relate to provision of a socket for applying or removing threaded and possibly other types of fasteners. According to some example embodiments, a socket is provided that includes a socket body and an anti-marring sleeve assembly. The anti-marring sleeve assembly may include a plurality of externally disposed, anti-marring sleeves that are configured to freely rotate about the socket body. A forward sleeve, closest to a fastener engagement aperture, may be additionally configured to translate axially relative to a center of turning motion when the socket is being turned by a tool (e.g., hand wrench or power driver). The radial rotation feature (allowing the forward sleeve to be stationary when the socket body is turning), the axial translation feature (limiting an amount of force that can be applied to a surface around a fastener), and the composition of the forward sleeve can provide anti-marring functionalities of the example socket, as further explained below. Additionally, an example socket may include a fastener engagement magnet assembly that is configured to magnetically hold a fastener within the fastener engagement aperture of the socket. The fastener engagement magnet may be configured to translate axially relative to a center of turning motion of the socket within a cavity of the socket body. The axial translation feature of the fastener engagement magnet assembly can provide for magnetic engagement with fasteners of differing depths while also facilitating anti-marring functionalities as further described below.

FIG. 1*a*. illustrates a cross-section perspective view of an example socket 100 according to some example embodiments, and FIG. 1*b* illustrates a cross-section side view of the example socket 100. With respect to example socket 100, the socket 100 may be comprised of a socket body 110, a sleeve assembly 120, and a magnet assembly 130. The socket body 110 may be composed of, for example, steel and be generally cylindrically shaped. The socket body 110 may include a rear aperture 111 and a forward aperture (also referred to as the fastener engagement aperture 112). The rear aperture 111 may be configured and sized to receive a drive tang of a tool, such as, for example a wrench or power driver. Near the rear aperture 111, the socket body 110 may include a hole or detent 117 that is configured to receive a pin, nub, bearing or the like affixed to the drive tang to hold the socket 100 in position on the drive tang. According to some example embodiments, the socket body 110 may be designed to be "chipfree" such that the socket body 110 does not include, for example, internal broach chips.

On the forward end of the socket body 110, the fastener engagement aperture 112 may be configured to marry with a fastener or at least a portion of a fastener (e.g., a nut, bolt head, etc.). The fastener engagement aperture 112 may accommodate a deep toothed recess that may be polygonal in shape. According to various example embodiments, the fastener engagement aperture 112 may be formed in a variety of shapes (e.g., hexagon, octagon, circular with inset grooves, etc.) that marry to corresponding fasteners. The fastener engagement aperture 112 may support DIN groove access. In FIGS. 1*a* and 1*b*, an example fastener is illustrated as lug nut 140. Lug nut 140 may be a specialized lug nut having an extended flange.

The fastener engagement aperture 112 may define an axis of rotation 150 that passes through the center of the aperture 112, the center of the rear aperture 111, and through the socket body 110. When the socket 100 is in use to turn a fastener, the rotation of the fastener, and in turn, the rotation of the fastener engagement aperture 112 and the rear aperture 111, may occur about the axis of rotation 150.

As mentioned above, the socket 100 may include a sleeve assembly 120. In function, the sleeve assembly 120 may operate to at least assist in performing an anti-marring function for the socket 100. The sleeve assembly 120 may be comprised of a plurality of sleeves that are affixed to the socket body 110. According to some example embodiments, the sleeves may be configured to rotate freely about the socket body 110 and, in some embodiments, the sleeves are concentric and can slide into or nest with each other. In this regard, the sleeve assembly 120 may include a rear sleeve 121 and a forward sleeve 122. According to some example embodiments, at least one of the sleeves may be constructed of or coated by an anti-marring or non-abrasive material, such as, for example, a polymeric material (e.g., urethane or the like). According to some example embodiments, one or more of the sleeves may be composed of or coated by Nylatron® or Nyloil® MDX. According to some example embodiments, the sleeves may be chip-free. Further, the sleeves of the sleeve assembly 120 may be configured to freely spin or rotate relative to the socket body 110 and the axis of rotation 150. This free spinning functionality can operate to permit a user of the socket 100 to grasp the socket 100 by the sleeves to hold them stationary while the socket body 110 turns within the sleeves during application or removal of a fastener. Accordingly, the ability to hold the sleeve assembly 120 in a stationary position while the socket body 110 is turning operates as an anti-marring feature, since the sleeves are not turning with the socket body 110 against a surface around the fastener.

The rear sleeve 121, also referred to as a drive cover, may be affixed to the socket body 110 towards the rear of the socket 100 or at least behind or rearward of the front sleeve 122. The rear sleeve 121 may be generally formed as a cylindrical tube. The rear sleeve 121 may be configured to rotate or spin radially about the socket body 110 and the axis of rotation 150. The rear sleeve 121 may be held in position on the socket body 110 by a ridge and groove engagement. According to some example embodiments, the rear sleeve 121 may include a ridge 123, and the socket body 110 may include a corresponding groove 118 that is formed about an outer circumference of the socket body 110. The ridge and groove engagement of the rear sleeve 121 with the socket body 110 may operate to permit radial movement of the rear sleeve 121 relative to the socket body 110, but prevent axial movement relative to the socket body 110.

The forward sleeve 122 (which may also be referred to as the front sleeve or the nose cover) may be affixed external to the socket body 110 at the forward end (i.e., the end adjacent the fastener engagement aperture 112). The rear sleeve 121 may be generally formed as a cylindrical tube. The forward sleeve 122 may be configured to rotate radially relative to the socket body 110 and the axis of rotation 150. Further, the forward sleeve 122 may be configured to also translate axially relative to the socket body 110 and the axis of rotation 150. In this regard, the forward sleeve 122 may include a stop 124 that extends towards the socket body 110 and engages with a projection 116 extending from the socket body 110 towards the forward sleeve 122 to prevent further forward axial movement of the forward sleeve 122 beyond engagement of the stop 124 with the projection 116.

In a retracted or partially retracted position (as depicted in FIGS. 1*a* and 1*b*), the forward sleeve 122 may translate into the rear sleeve 121. In this regard, the forward sleeve 122 may have at least a portion of the sleeve that has an outer diameter that is smaller than the inner diameter of the rear sleeve 121 to facilitate nesting of the sleeves. Alternatively, according to some example embodiments, the forward sleeve 122 (or a portion of the forward sleeve 122) may have an inner diameter that is larger than the outer diameter of the rear sleeve 121, and the forward sleeve 122 may be configured to translate over the rear sleeve 121.

According to some example embodiments, the sleeve assembly 120 may further include a biasing member 126 (e.g., a spring or other member that exhibits elastic properties). The biasing member 126 may be disposed so as to urge the forward sleeve 122 to translate axially relative to the socket body 110 and the axis of rotation 150 in a direction towards the forward end of the socket body 110. In this regard, the biasing member 126 may be engage with both the socket body 110 and the forward sleeve 122. According to some example embodiments, the biasing member may alternatively be disposed between, and engage with both, the rear sleeve 121 and the forward sleeve 122 to urge the forward sleeve 122 in the forward direction towards the forward end of the socket 100.

According to some example embodiments, the forward sleeve 122 may include a lip 125 disposed on the forward end of the sleeve 122. The lip 125 may extend towards the center of the fastener engagement aperture 112. In this regard, the lip 125 may be configured to engage with a flange or other surface of a fastener. In FIGS. 1*a* and 1*b*, the lip 125 is shown engaging with a flange 141 of the lug nut 140. Because forward sleeve 122 may be composed of an anti-marring material, when the lug nut 140 turns with the socket body 110 and the forward sleeve 122 remains stationary, for example, the lip 125 will not mar the flange 141 surface that physically contacts the lip 125. Further, because the lip 125 is held by the flange 141 at a position away from a surface surrounding the fastener during application or removal (e.g., surface of a wheel rim around the lug nut 140 when applied or removed), the forward sleeve 122 does not contact the surface and therefore cannot mar the surface.

According to some example embodiments, the socket 100 may further comprise a magnet assembly 130. The magnet assembly 130 may function to magnetically attract and hold a fastener or portion of a fastener in place at the forward end of the socket body 110 within the fastener engagement aperture 112 to assist the user of the socket 100 when applying or removing a fastener. While in some example embodiments, the magnet assembly may comprise only an appropriately shaped magnet, the magnet assembly 130 may alternatively comprise a magnet 131 and a sled 132. In this regard, the magnet 131 may be composed of any type of magnetic material including, for example, neodymium or rare earth. The magnet assembly 130 may be movably housed within an internal cavity 113 (e.g., machined cavity) of the socket body 110. According to some example embodiments, the internal cavity 113 may be disposed between the fastener engagement aperture 112 and the rear aperture 111. Further, in some example embodiments, the magnet 131 may be affixed to a sled 132. The sled 132 may, in some example embodiments, be composed of brass or another non-ferrous material. The sled 132 with the magnet 131 may be configured to travel or translate within the internal cavity 113 of the socket body 110. In a forward position within the internal cavity 113, the magnet may extend forward, out of the internal cavity 113, and into at least a portion of the fastener engagement aperture 112. In this regard, the magnet 131 and, in some example embodiments, the sled 132 may be constrained to move or translate axially within the internal cavity 113 relative to the socket body 110 and the axis of rotation 150.

Movement of the magnet assembly 130 may be constrained within the internal cavity 113 in the forward direction by a stop 133 of the magnet assembly 130 (or more specifically, for example, a stop 133 of the sled 132) engaging with a projection 114 of the socket body 110 in the internal cavity 113. According to some example embodiments, movement of the magnet assembly 130 in the rearward direction may be constrained by, for example, a retaining ring 134 secured within a groove 115 of the socket body 110 within the internal cavity 113. The movement of the magnet assembly 130 can permit the socket 100 to be used in conjunction with a variety of fasteners having different shapes, styles, and lengths. For example a longer fastener may extend further into the internal cavity 113 and the magnet assembly 130 can move rearward within the internal cavity to accommodate the longer fastener. Further, as seen with respect to FIGS. 2*a* and 2*b*, a fastener having a narrower or less pronounced flange may permit the lip 125 to pass by the fastener, but magnet assembly 130 may remain magnetically engaged with the fastener to hold the fastener in place within the fastener engagement aperture 112.

According to some example embodiments, during assembly of the socket 100, the magnet assembly 130 may be installed into the internal cavity 113 via the rear aperture 111. In this regard, the magnet assembly may be sized to pass through the rear aperture 111 into the internal cavity 113, but, according to some example embodiments, stop upon engagement with the projection 133. Further, in this regard, the inner diameter of the rear aperture 111 and the internal cavity 113 may be larger than the outer diameter of the magnet assembly 130. During assembly, and after the magnet assembly 130 is disposed within the internal cavity 113, the retaining ring 134 may be installed in the groove 115 to operate as a rearward movement stop for the magnet assembly 130.

As depicted in FIGS. 1*a* and 1*b*, according to some example embodiments, the urging force of the biasing member 126 may operate to push the forward sleeve 122 and a fastener 140 that is engaged with the lip 125 of the forward sleeve 122 in the forward direction and away from the forward end of the socket body 110. However, according to some example embodiments, the magnet 131 may be configured to provide sufficient magnetic, attractive force to overcome the force generated by biasing member 126 imposed on the fastener 140 via the forward sleeve 122 and lip 125. As a result, the biasing member 126 (e.g., a spring) may be compressed by the force provided by the magnet 131. In other words, the magnetic force provided by the magnet 131 on the fastener 140 may be stronger than the urging force provided by the biasing member 126 on the fastener via the lip 125 of the forward sleeve 122. As a result, the fastener 140 may be held in place within the fastener engagement aperture 112 even when engaged with the forward sleeve 122.

FIG. 2*a*. illustrates a cross-section perspective view, and FIG. 2*b*. illustrates a crosssection side view, of the example socket 100 according to some example embodiments, where the socket 100 is in engagement with a different fastener. In this regard, lug nut 140' has a smaller flange 141' and is longer in length than the lug nut 140 of FIGS. 1*a* and 1*b*. As can be seen in FIGS. 2*a* and 2*b*, the forward sleeve 122 has translated towards the forward end of the socket body 110 to a fully extended position. In the fully extended position, the forward edge of the forward sleeve 122 may extend beyond the forward edge of the socket body 110. In this regard, stop 124 may be engaged with projection 116. Because the flange 141' is smaller, flange 141' does not extend outward far enough to engage with the lip 125 of the forward sleeve 122. Therefore, the forward sleeve 122 can fully extend such that the lug nut 140' is, in this case, fully housed within the forward sleeve 122 and does not extend beyond the lip 125.

Further, with respect to FIGS. 2*a* and 2*b*, the magnet assembly 130 is shown in a position that is further rearward and nearly abutting the retaining ring 134. Because magnet assembly 130 can translate or slide in the rearward and forward directions, socket 100 can accommodate fasteners that are longer in length, such as lug nut 140'.

Because lip 125 may extend forward beyond the forward end of the fastener, the forward edge and lip 125 of the forward sleeve 122 may come into direct physical contact with the surface surrounding the fastener (e.g., the surface of the wheel rim) during application or removal of the fastener 140'. However, because the forward sleeve 122 may be composed of an anti-marring material, and because the forward sleeve 122 can freely rotate relative to the socket body 110 (e.g., in response to being held by a user or due to physical engagement with the surface surrounding the fastener), and because the forward sleeve 122 is configured to translate in the rearward direction upon physical interaction with the surface surrounding the fastener, marring of the surface around the fastener is avoided.

FIG. 3 illustrates a perspective view of the example socket 100 according to an example embodiment, where the example socket is not engaged with a fastener. In this regard, similar to FIGS. 2*a* and 2*b*, forward sleeve 122 is depicted in a fully forward extended position. Similarly, FIG. 4*a* illustrates a side view of the example socket 100 without a fastener, according to an example embodiment, where the forward sleeve 122 is located in a fully forward extended position. The internal elements of the socket 100 in FIG. 4*a* are shown in dotted lines. Further, FIG. 4*b* illustrates a rear view of the example socket 100 according to an example embodiment, and FIG. 4*c* illustrates a front view of an example socket according to an example embodiment.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A socket comprising:

a socket body comprising a fastener engagement aperture configured to receive at least a portion of a fastener and a rear aperture configured to receive a drive tang of a tool, the socket body defining an axis of rotation that passes through a center of the fastener engagement aperture;

a forward sleeve affixed external to the socket body at a forward end of the socket body adjacent the fastener engagement aperture, the forward sleeve being configured to rotate radially relative to the socket body and the axis of rotation, and the forward sleeve being configured to translate axially relative to the socket body and the axis of rotation, the forward sleeve comprising a lip configured to engage a flange of the fastener;

a biasing member configured to urge the forward sleeve to translate axially relative to the socket body and the axis of rotation in a direction towards the forward end of the socket body;

a magnet assembly comprising a magnet, the magnet assembly being disposed within the an internal cavity of the socket body, the magnet being configured to magnetically attract the fastener to the forward end of the socket body and, in response to the lip of the sleeve being engaged with the flange of the fastener, an attractive force of the magnet imposed on the fastener is configured to compress the biasing member against an urging force of the biasing member, the magnet assembly being sized to pass through the rear aperture into the internal cavity and stop upon engagement with a projection disposed within the internal cavity of the socket body; and a retaining ring secured within a groove disposed in the internal cavity, the retaining ring being configured to retain the magnet assembly within the internal cavity.

2. The socket of claim 1 further comprising a rear sleeve affixed to the socket body rearward of the forward sleeve relative to the forward end of the socket body, the rear sleeve being configured to rotate radially about the socket body and the axis of rotation;

wherein one of the forward sleeve or the rear sleeve nests within the other of the forward sleeve or the rear sleeve.

3. The socket of claim 1 wherein the forward sleeve is composed of an anti-marring material.

4. The socket of claim 3 wherein the anti-marring material is a urethane.

5. The socket of claim 1 wherein the magnet assembly is configured to translate axially within the internal cavity relative to the socket body and the axis of rotation.

6. A socket comprising:

a socket body comprising an internal cavity and a fastener engagement aperture, the fastener engagement aperture being disposed at a forward end of the socket body and configured to receive at least a portion of a fastener, the socket body defining an axis of rotation that passes through a center of the fastener engagement aperture;

a forward sleeve affixed external to the socket body adjacent the fastener engagement aperture, the forward sleeve comprising a lip configured to engage a flange of the fastener;

a biasing member configured to urge the forward sleeve to translate axially relative to the socket body and the axis of rotation in a direction towards the forward end of the socket body; and a magnet disposed within the internal cavity of the socket body, the magnet being configured to translate axially within the internal cavity relative to the socket body and the axis of rotation, the magnet being configured to magnetically attract the fastener to the forward end of the socket body and, in response to the lip of the sleeve being engaged with the flange of the fastener, an attractive force of the magnet imposed on the fastener is configured to compress the biasing member against an urging force of the biasing member;

wherein the socket further comprises a magnet assembly, the magnet assembly comprising the magnet and a sled, the magnet being affixed to the sled;

wherein the socket body further comprises a rear aperture and a projection, the rear aperture being configured to receive a drive tang of a tool and the projection being disposed within the internal cavity, wherein the magnet assembly is sized to pass through the rear aperture into the internal cavity and stop upon engagement with the projection;

wherein the projection is disposed at a forward end of the internal cavity; and wherein the socket further comprises a retaining member being disposed at a rear end of the internal cavity, the retaining member being disposed to retain the magnet assembly within the internal cavity.

7. The socket of claim 6 wherein the sled is composed of brass.

8. The socket of claim 6 wherein the forward sleeve is configured to rotate radially relative to the socket body and the axis of rotation, and the forward sleeve is configured to translate axially relative to the socket body and the axis of rotation.

9. The socket of claim 8 further comprising a rear sleeve affixed to the socket body rearward of the forward sleeve relative to the forward end of the socket body, the rear sleeve being configured to rotate radially about the socket body and the axis of rotation;

wherein one of the forward sleeve or the rear sleeve nests within the other of the forward sleeve or the rear sleeve.

10. The socket of claim 6 wherein the forward sleeve is composed of an anti-marring material.

11. The socket of claim 10 wherein the anti-marring material is a urethane.

* * * * *